US011772122B2

(12) United States Patent
Clarke et al.

(10) Patent No.: US 11,772,122 B2
(45) Date of Patent: Oct. 3, 2023

(54) CORNER PAINT ROLLER SYSTEM AND METHOD

(71) Applicant: STARKE LLC, Spokane Valley, WA (US)

(72) Inventors: Christopher Clarke, Spokane, WA (US); Chad Clarke, Spokane Valley, WA (US)

(73) Assignee: STARKE LLC, Spokane Valley, WA (US)

( * ) Notice: Subject to any disclaimer, the term of this patent is extended or adjusted under 35 U.S.C. 154(b) by 0 days.

(21) Appl. No.: 16/479,167

(22) PCT Filed: Jan. 19, 2018

(86) PCT No.: PCT/US2018/014548
§ 371 (c)(1),
(2) Date: Jul. 18, 2019

(87) PCT Pub. No.: WO2018/136809
PCT Pub. Date: Jul. 26, 2018

(65) Prior Publication Data

US 2019/0344305 A1 Nov. 14, 2019

Related U.S. Application Data

(60) Provisional application No. 62/499,324, filed on Jan. 23, 2017.

(51) Int. Cl.
*B05C 17/02* (2006.01)

(52) U.S. Cl.
CPC ..... *B05C 17/0212* (2013.01); *B05C 17/0207* (2013.01); *B05C 17/0217* (2013.01); *B05C 17/0232* (2013.01); *B05C 17/0235* (2013.01)

(58) Field of Classification Search
CPC ..... B05C 17/0225; B05C 17/0212; B05C 17/0207; B05C 17/0232; B05C 17/0235; B05C 17/0217
(Continued)

(56) References Cited

U.S. PATENT DOCUMENTS 2,321,511 A * 6/1943 Piercy ..... B05C 17/0232 15/230.11
2,680,873 A 6/1954 Ernst
(Continued)

OTHER PUBLICATIONS

International Search Report and Written Opinion dated May 16, 2018, International Patent Application No. PCT/US2018/014548, filed Jan. 19, 2018, 15 pages.

*Primary Examiner* — Katina N. Henson
(74) *Attorney, Agent, or Firm* — Davis Wright Tremaine LLP

(57) ABSTRACT

A paint roller assembly, comprising a frame assembly including a handle and a frame, where one end of the frame is attached to the handle and the other end includes a cross-member structure attached to the frame opposite and orthogonal to the handle end, a first paint roller cage rotatably mounted on a first branch of the cross-member section, and a second paint roller cage rotatably mounted on a second branch of the cross-member structure. Optionally, a first paint roller cover can be placed over the first paint roller cage, and a second paint roller cover can be placed over the second paint roller cage, wherein at least one of the first paint roller cage and second paint roller cage has an end covered in paint-absorbing material for applying paint into a corner between adjacent surfaces.

4 Claims, 14 Drawing Sheets

(58) Field of Classification Search
USPC ..... 15/230.11; 401/197, 15; 492/30, 28
See application file for complete search history.

(56) References Cited

U.S. PATENT DOCUMENTS

| | | | | |
|---|---|---|---|---|
| 2,693,893 | A | 11/1954 | Rice | |
| 2,972,158 | A | 2/1961 | Voskresenski | |
| 3,562,837 | A * | 2/1971 | Baginski | B05C 17/0232 15/230.11 |
| 3,612,707 | A | 10/1971 | Herbrechter et al. | |
| 5,339,484 | A | 8/1994 | Polzin et al. | |
| 5,613,264 | A | 3/1997 | Knowles | |
| 6,185,780 | B1 | 2/2001 | Napolitan | |
| 6,331,327 | B1 * | 12/2001 | Jackson | B05C 17/0207 427/260 |
| 6,976,284 | B1 | 12/2005 | Manfredi et al. | |
| 7,281,291 | B1 * | 10/2007 | Hajianpour | B05C 17/0227 492/19 |
| 2008/0081752 | A1 * | 4/2008 | Fellinger | A47L 11/26 492/28 |
| 2012/0272470 | A1 * | 11/2012 | Gallardo | B05C 17/023 15/230.11 |
| 2013/0340192 | A1 | 12/2013 | DeCarr et al. | |

* cited by examiner

CORNER PAINT ROLLER SYSTEM AND METHOD

CROSS-REFERENCE TO RELATED APPLICATIONS

This application claims the benefit of U.S. Provisional Application No. 62/499,324, filed Jan. 23, 2017, which application is hereby incorporated herein by reference in its entirety and for all purposes.

BACKGROUND

A significant portion of the time required to paint the walls and interior surfaces of a room is spent on preparing the room for painting. This preparation typically includes "cutting in" the corners where adjacent surfaces meet (e.g., between two walls, between the wall and ceiling, etc.) Cutting in, also known as trimming, involves using a small brush to apply paint next to trim, moldings, and corners before painting the flat surfaces of a wall or ceiling with a roller brush. Depending on the size and features of a room, cutting in can take as much time or more as painting the walls itself.

A commonly used device for painting the expanse of the interior surfaces of a room is a paint roller, which includes a cylindrical roller cover covered in paint-absorbing material mounted on a spring cage which rotates about the shaft of a frame. The roller cover is dipped in paint and then used to paint large expanses, such as those of a wall or ceiling. While the roller works well for covering large areas quickly, a typical roller cannot apply paint in the corner between two adjacent surfaces, thus requiring cutting in or the use of special, separate tools or brushes to paint into the corner.

Figure 1A:
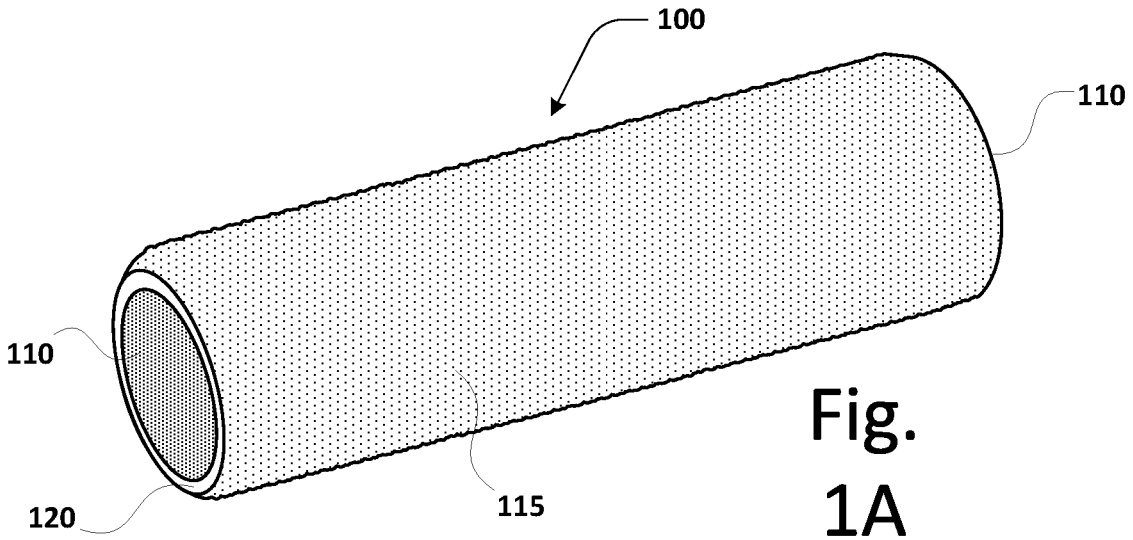
Fig. 1A PRIOR ART
FIG. 1A is a perspective view of a prior art paint roller cover.

It should be noted that the figures are not drawn to a consistent scale and that elements of similar structures or functions are generally represented by like reference numerals for illustrative purposes throughout the figures. It also should be noted that the figures are only intended to facilitate the description of example embodiments. The figures do not illustrate every aspect of the described embodiments and do not limit the scope of the present disclosure.

DETAILED DESCRIPTION OF THE PREFERRED EMBODIMENTS

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Techniques described and suggested include methods and devices for the application of a coating to the interior surfaces of a room, including the corners where adjacent surfaces meet (for example, where two walls meet, a wall meets a ceiling, a wall meets a floor, etc.) Example embodiments can include a paint roller assembly, a paint roller cover, and combinations thereof, as well as methods of manufacture.

For the purposes of this specification, a "coating" is defined as any appropriate liquid material applied to a surface (such as a wall, ceiling, floor, etc.) used for the protection and/or covering of that surface. These materials include, but are not limited to, latex paints, oil-based paints, primers, sealants, industrial coatings, resins, lacquers, enamels, varnishes, and metallic coatings. For the purposes of this specification, the terms "coating" and "paint" shall be used interchangeably.

Figure 1B:
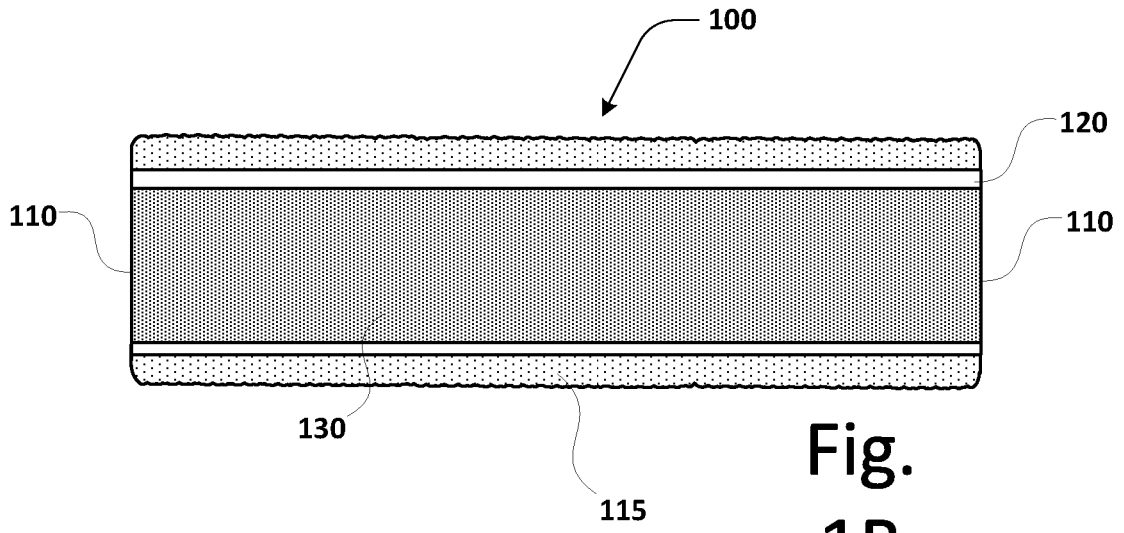
Fig. 1B PRIOR ART
FIG. 1B is a cross-sectional front view of a prior art paint roller cover.

Turning now to the figures, various embodiments of the paint roller assembly will be described in more detail. FIG. 1A is a perspective drawing of a typical paint roller cover of the prior art. FIG. 1B is a cross-sectional front view of the same prior art paint roller cover. The prior art paint roller cover 100 typically includes an inner cylindrical core (or simply "inner core") 120 covered with a paint-absorbing material 115. The inner core 120 is shaped as a hollow cylinder or tube, with two open ends 110. The inner surface 130 of the inner core 120 is typically smooth and the diameter of the inner core 120 is designed to fit snugly over the spring cage of a paint roller (not shown, see FIG. 1C).

For the purposes of this specification, a "paint-absorbing material" shall be defined as any appropriate material that can absorb or otherwise at least temporarily retain a coating (such as paint) and then release the coating onto the surface being covered when the paint-absorbing material comes in contact with the surface. Paint-absorbing materials can include, but are not limited to, synthetic materials (such as nylon, Dacron, or polyester), natural materials (such as mohair or sheepskin), and blended materials (for example, a polyester/wool blend.) A paint-absorbing material can be, for example, a foam or a pile fabric, where "pile" refers to the thickness of the nap of the fibers covering the roller cover. Typical pile types available can include very smooth, smooth, semi-smooth, semi-rough, rough, and very rough.

An inner core for a paint roller cover may be constructed of any appropriate material, including but not limited to plastic (including thermoplastic), phenolic-treated cardboard, and untreated cardboard cores. In some embodiments, the paint-absorbing material can be attached to the inner core by moisture-resistant adhesives or epoxies, through thermally bonding the paint-absorbing material to an inner core constructed of thermoplastic (that is, heating the thermoplastic such that it develops an adhesive quality), or through any appropriate adhesion method.

Figure 1C:
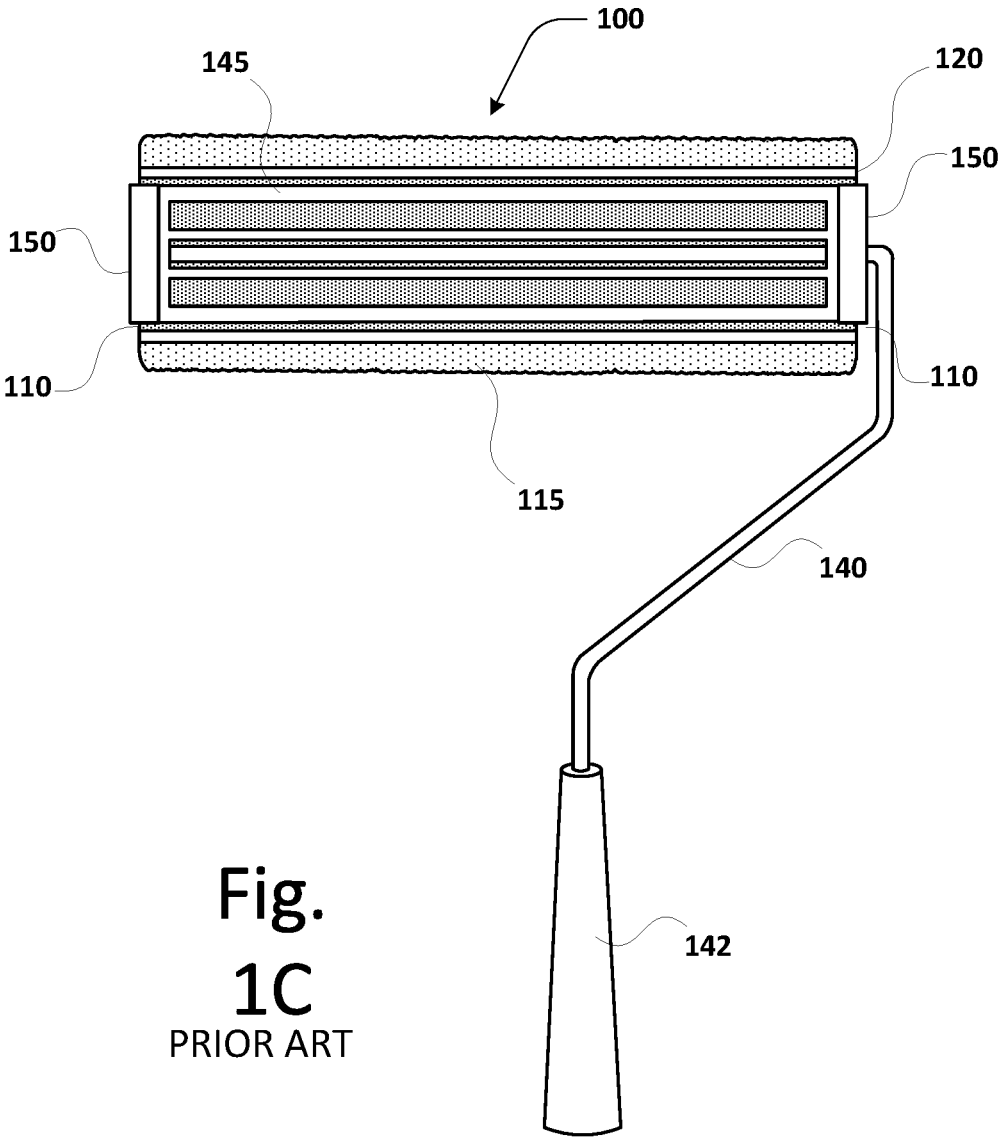
Fig. 1C PRIOR ART
FIG. 1C is a cross-sectional front view of a prior art paint roller assembly.

Returning now to the drawings, FIG. 1C is a cross-sectional front view of a prior art paint roller assembly, showing how the paint roller cover 100 is placed on the spring cage 145 of the paint roller. An end piece 150 is mounted on both ends of the spring cage 145, and the assembly of spring cage 145 and end pieces 150 is mounted such that it spins freely on the portion of a roller frame 140 which is substantially horizontal to handle 142. In some embodiments, the end pieces 150 extend past the open ends 110 of the paint roller cover 100, and that the paint-absorbing material 115 does not extend past or over the open ends 110 of the paint roller cover 100. This attribute of prior art paint roller devices is a limitation, in that it prevents the paint roller from effectively applying paint into the corner where two adjacent surfaces meet, requiring cutting in which adds significant time to the overall painting process.

Figure 2A:
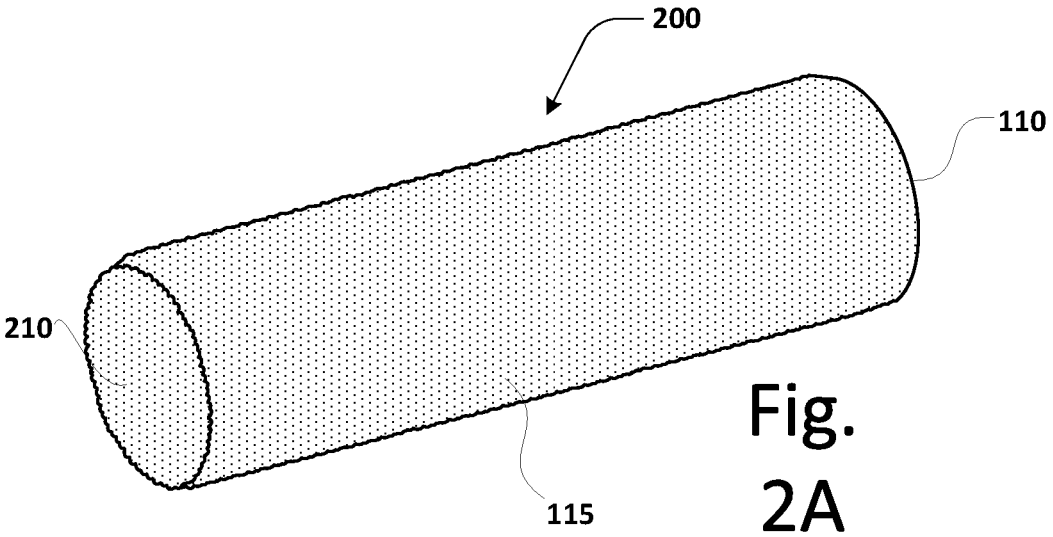
FIG. 2A is a perspective view illustrating an example corner paint roller cover, in accordance with an embodiment.
Figure 2B:
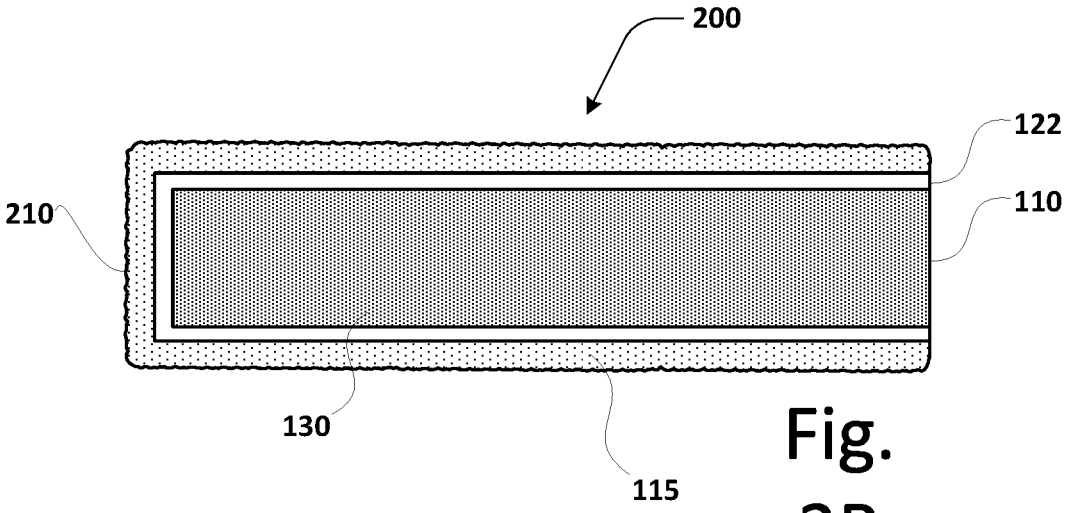
FIG. 2B is a cross-sectional front view illustrating an example corner paint roller cover, in accordance with an embodiment.

FIG. 2A is a perspective view illustrating an example embodiment of a corner paint roller cover of the present invention. FIG. 2B is a cross-sectional front view of the same example embodiment of a corner paint roller cover as FIG. 2A. A corner paint roller cover 200 includes an inner cylindrical core (or simply "inner core") 122 covered with a paint-absorbing material 115. The inner core 122 is shaped as a hollow cylinder or tube, with one open end 110 and one closed end 210. It should be noted that the paint-absorbing material 115 extends over closed end 210. The inner surface 130 of the inner core 122 is typically smooth and the diameter of the inner core 122 is designed to fit snugly over the spring cage of a paint roller (not shown, see FIG. 2E).

Variations of the embodiment described are considered as being within the scope of the disclosure. For example, closed end 210 of inner core 122 may not be completely closed, and/or the paint-absorbing material 115 may not extend over the entire surface of closed end 210. In some embodiments, benefits similar to those seen with a completely closed end 210 may be achieved when the paint absorbing material 115 extends just over the closed end 210, leaving a center portion of closed end 210 exposed. In other embodiments, closed end 210 can be removed entirely (that is, replaced with an open end 110), but with the paint-absorbing material 115 covering the open end 110. In other words, the same benefits may be seen by covering the open end only with the paint-absorbing material without closing the end of the inner core itself.

Figure 2C:
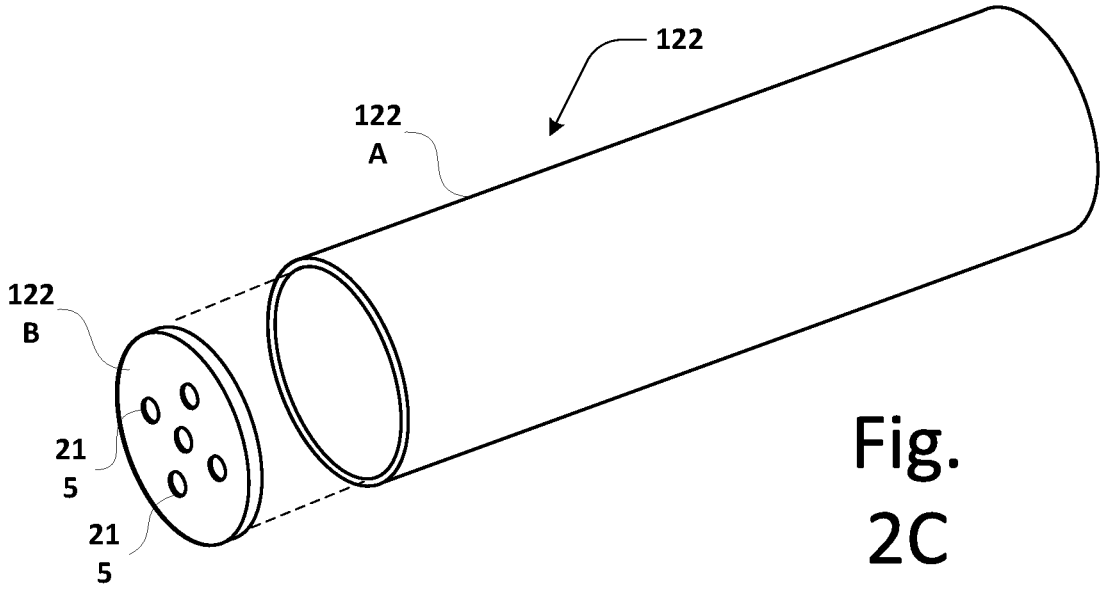
FIG. 2C is an exploded, perspective view illustrating an example inner core and end cap assembly for a corner paint roller cover, in accordance with an embodiment.
Figure 2D:
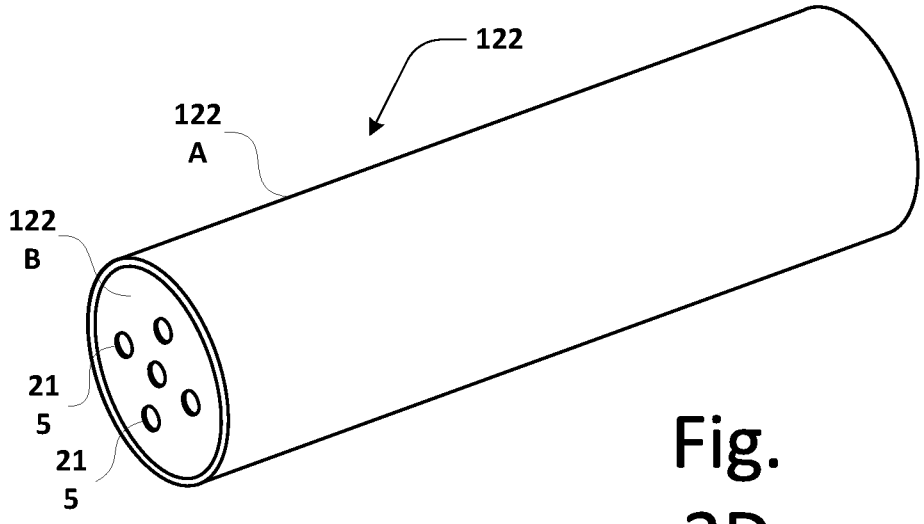
FIG. 2D is a perspective view illustrating an example assembled inner core and end cap assembly for a corner paint roller cover, in accordance with an embodiment.

FIG. 2C is an exploded, perspective view illustrating an embodiment of an inner core and end cap assembly for a corner paint roller cover. FIG. 2D is a perspective view showing the same embodiment of inner core and end cap as they appear when assembled. In an embodiment, the inner core 122 includes a hollow, open-ended, cylindrical section 122A and an end cap 122B. The end cap 122B is attached to the cylindrical section 122A such that one end of the inner core 122 is partially or entirely closed. The end cap 122B may be attached to the cylindrical section 122A by any appropriate method, including but not limited to an adhesive, epoxy, thermal bonding, tape, or snap fit. The end cap 122B may be sized such that it fits inside the inner diameter of an open end of the cylindrical section 122A, over the outer diameter of an open end of the cylindrical section 122A, or such that it matches the outer diameter of the cylindrical section 122A. The end cap 122B may be a solid piece, completely sealing off an open end of the cylindrical section 122A, may have one or more holes 215, or may only partially cover the open end of the cylindrical section 122A. The inclusion of holes 215 or use of a partial end cap 122B will allow air to pass through the end cap 122B, aiding in the removal of the roller cover from a roller cover frame.

It should be noted that the embodiment of the inner core 122 shown in FIGS. 2C and 2D is intended only as an example, and is not meant to be limiting. It is important to note that variations of the inner core 122 are considered as being within the scope of the disclosure. For example, end cap 122B and cylindrical section 122A can be formed as a single piece, using a single process, such as an injection molding process or other appropriate manufacturing method. Holes 215 can be added to the mold of the injection molding process, or added during a separate, subsequent process, such as by drilling, cutting, or punching.

Figure 2E:
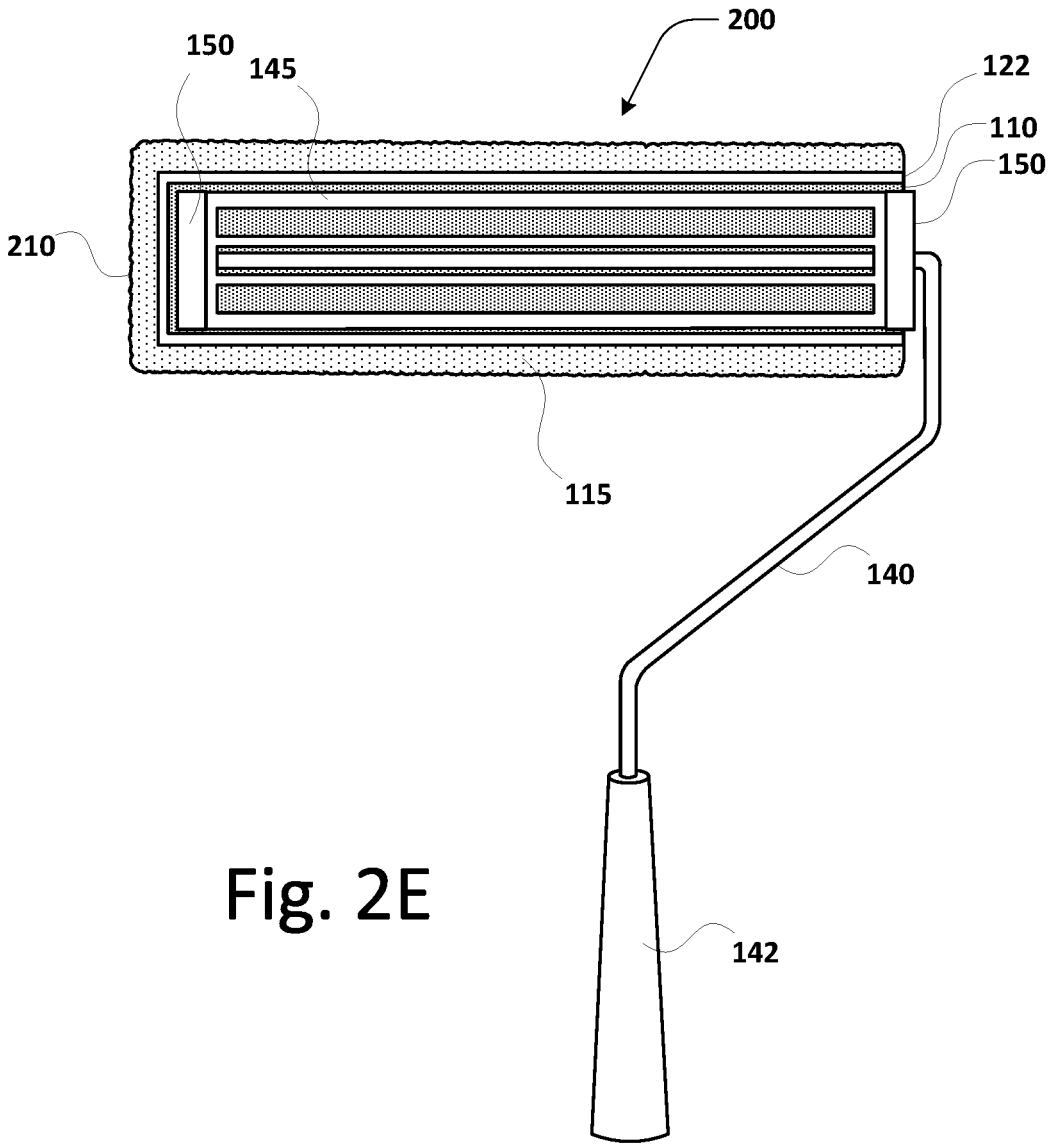
FIG. 2E is a cross-sectional front view of an example corner paint roller assembly using a closed-end paint roller cover, in accordance with an embodiment.

FIG. 2E is a cross-sectional front view of an embodiment of a corner paint roller assembly using the closed-end paint roller cover 200. It should be noted that the paint roller assembly (including handle 142, frame 140, spring cage 145, and end pieces 150, but not including the paint roller cover 200) is identical to the embodiment of the same items in FIG. 1C, and the same reference designators are used to label the same components in both drawings. In the embodiment of FIG. 2E, paint roller cover 200 is placed over spring cage 145. In this embodiment, the closed end 210 of paint roller cover 200 is shown completely covering one of the end pieces 150.

Figure 2F:
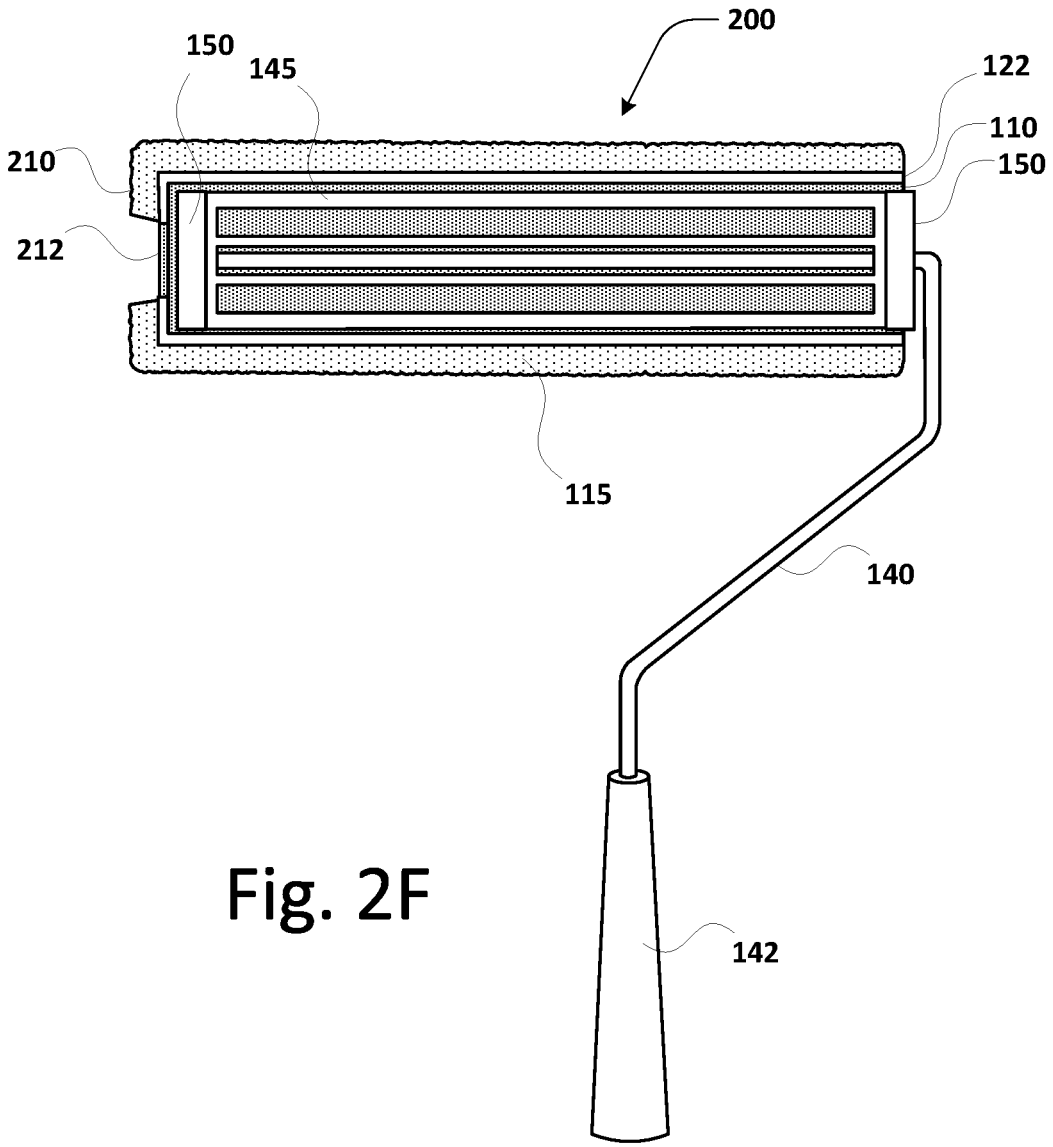
FIG. 2F is a cross-sectional front view of an example corner paint roller assembly of FIG. 2E, in accordance with an embodiment.

FIG. 2F is a cross-sectional front view of an alternate embodiment of the corner paint roller assembly of FIG. 2E. In this embodiment, the paint-absorbing material 115 and inner core 122 only partially cover closed end 210, leaving an uncovered portion 212 in closed end 210. In this embodiment, the term "closed end" refers to an end which is more closed than a completely open end 110. It should be noted that the size of the uncovered portion 212 may be different in the paint-absorbing material 115 than that in the inner core 122, or that either the paint-absorbing material 115 or the inner core 122 may be independently fully or partially closed.

Figure 3:
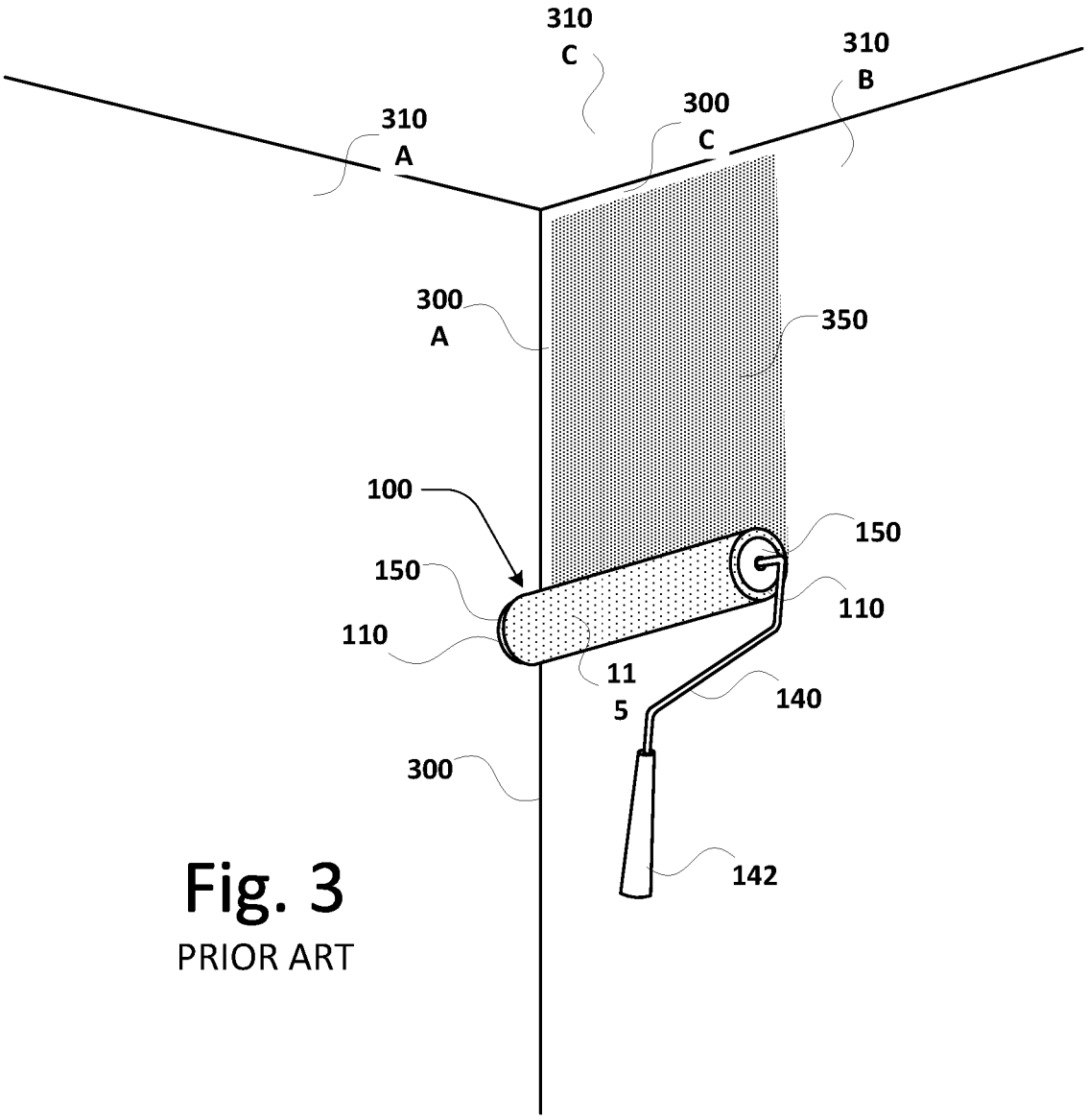
Fig. 3 PRIOR ART
FIG. 3 is a perspective view of a prior art paint roller assembly applying paint near an inner corner of a room.
Figure 4:
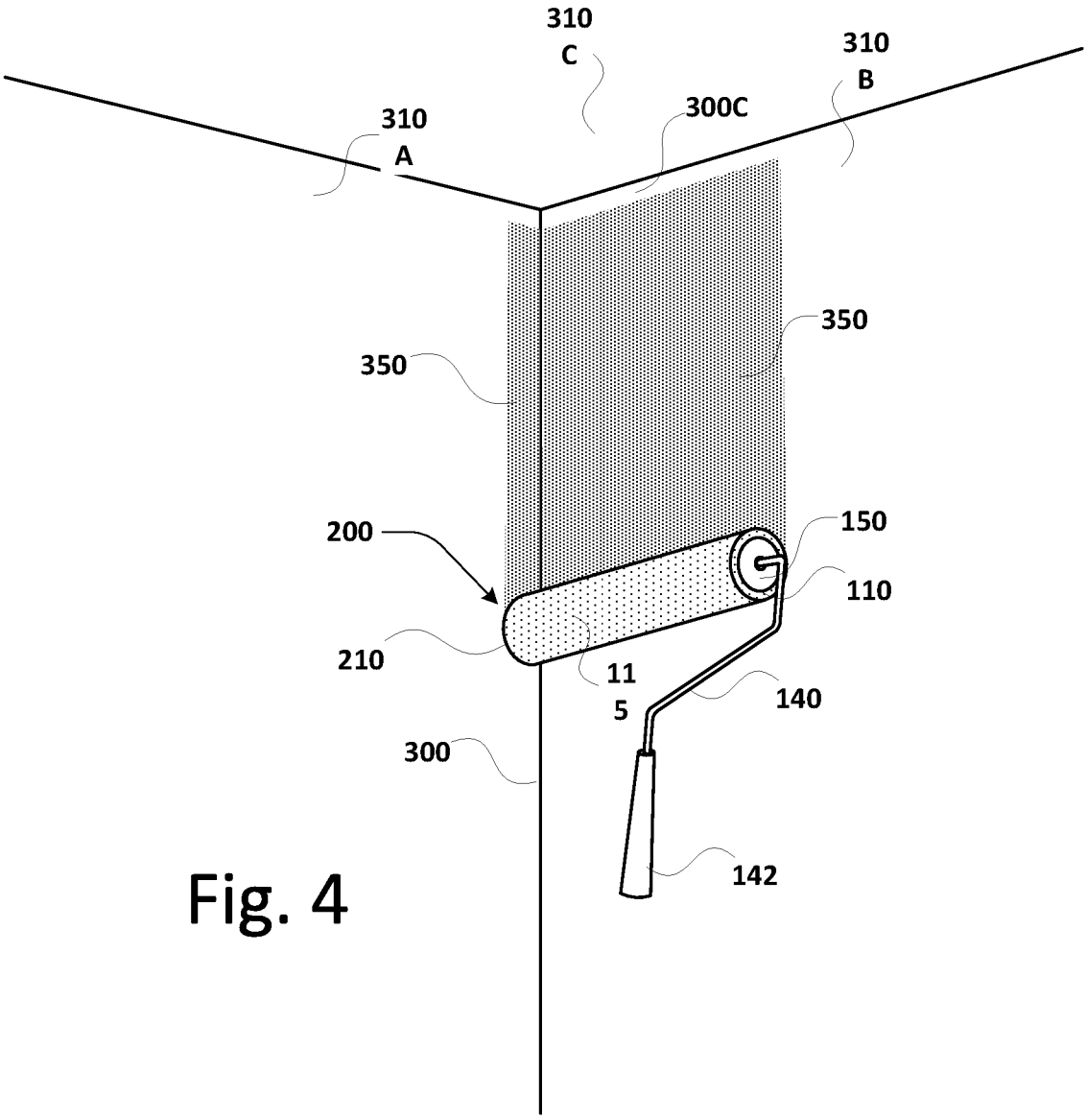
FIG. 4 is a perspective view of an example corner paint roller assembly applying paint to an inner corner of a room, in accordance with an embodiment.
Figure 5:
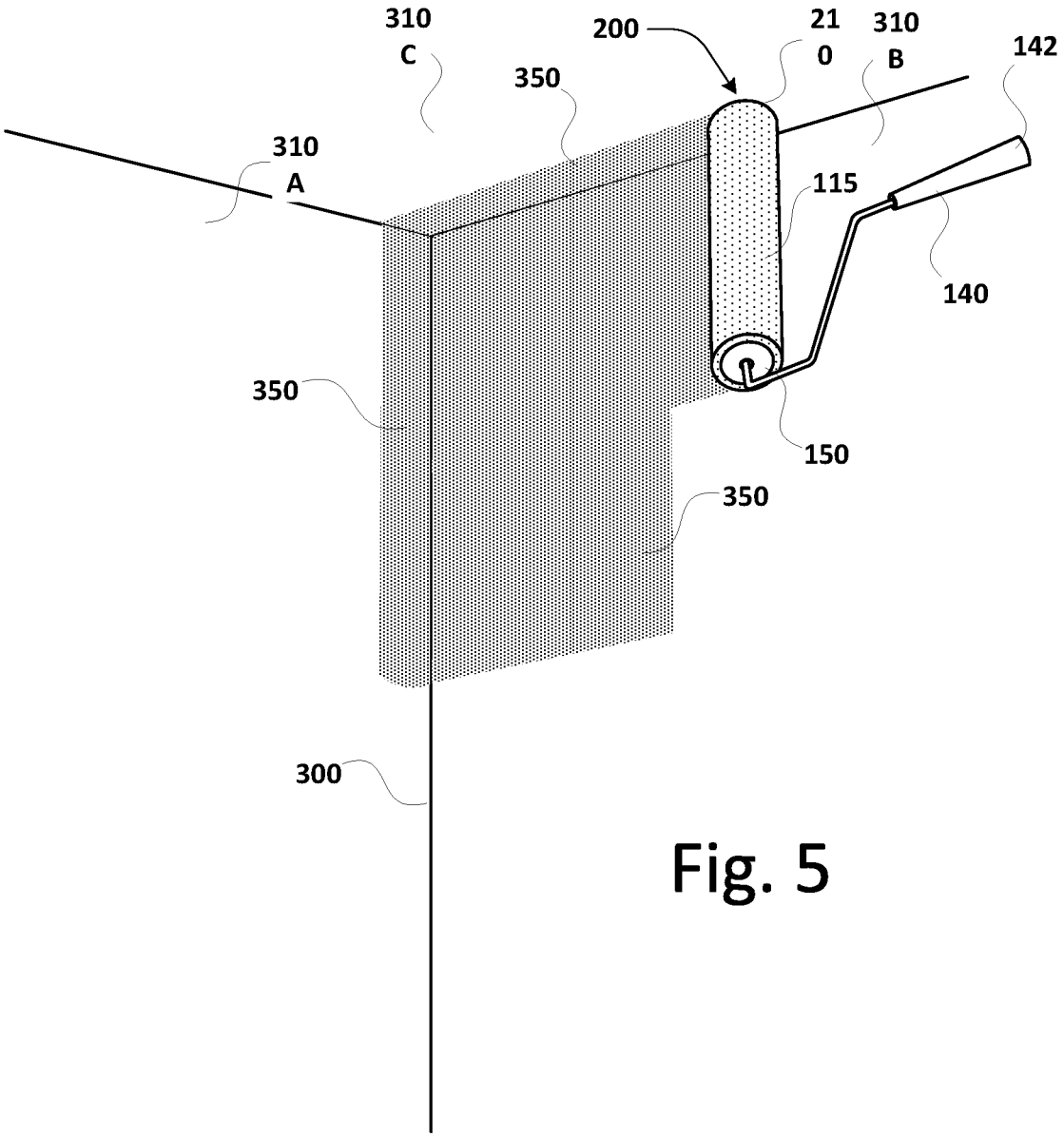
FIG. 5 is a perspective view of an example corner paint roller assembly applying paint to a corner where a ceiling meets a wall, in accordance with an embodiment.

FIGS. 3-5 provide examples of the use of both prior art systems and the present invention in applying paint to the interior surfaces of a room. Items shown that are common among FIGS. 3-5 are shown with the same reference designators, and thus share the same descriptions.

FIG. 3 is a perspective view of a prior art paint roller applying paint near an inner corner of a room. In this example, a corner 300 is shown formed by three adjacent surfaces, a first wall 310A, a second wall 310B, and a ceiling 310C. Prior art paint roller cover 100 is shown in place on paint roller frame 140. A user of the paint roller (not shown) holding the paint roller by handle 142 would move the paint roller over the surface of the wall 310B (for example), allowing paint 350 to be transferred from the roller cover 100 onto the wall 310B. However, because prior art paint roller cover 100 has two open ends 110 and the paint-absorbing material 115 does not cover either of the open ends 110, the paint roller cannot paint into the corner 300, leaving a gap 300A that is not covered by paint 350. Similarly, there is a gap 300C near ceiling 310C which is left unpainted, even if the paint roller is rotated so that the length of roller cover 100 is parallel to the line formed by corner 300. The lack of paint-absorbing material 115, as well as the possibility that end piece 150 extends past the end of the paint roller cover 100, prevents the paint roller from getting close enough to apply paint to corner 300. A separate tool, such as a small paintbrush (not shown), must be used to cut in the gaps 300A and 300C.

FIG. 4 is a perspective view of a corner paint roller assembly applying paint to an inner corner of a room. As with FIG. 3, a corner 300 is shown formed by three adjacent surfaces, a first wall 310A, a second wall 310B, and a ceiling 310C. However, in the embodiment shown in FIG. 4, paint roller cover 200, with closed end 210, is placed over paint roller frame 140. A user of the paint roller (not shown) holding the paint roller by handle 142 would move the paint roller over the surface of the wall 310B (for example), allowing paint 350 to be transferred from the roller cover 200 onto the wall 310B. In contrast to the prior art example of FIG. 3, because paint roller cover 200 has closed end 210, which is at least partially covered with paint-absorbing material 115, the paint roller is able to apply paint 350 into the corner 300. Although the paint roller still leaves a gap 300C in the paint near ceiling 310C, this is easily corrected by rotating the paint roller so that the length of roller cover 200 is substantially parallel to the line formed by corner 300. This is illustrated in FIG. 5, which shows the paint roller rotated such that closed end 210 is in contact with ceiling 310C. The use of paint roller cover 200 with closed end 210 prevents or significantly reduces the need for a separate tool or paintbrush for cutting in corners.

Figure 6A:
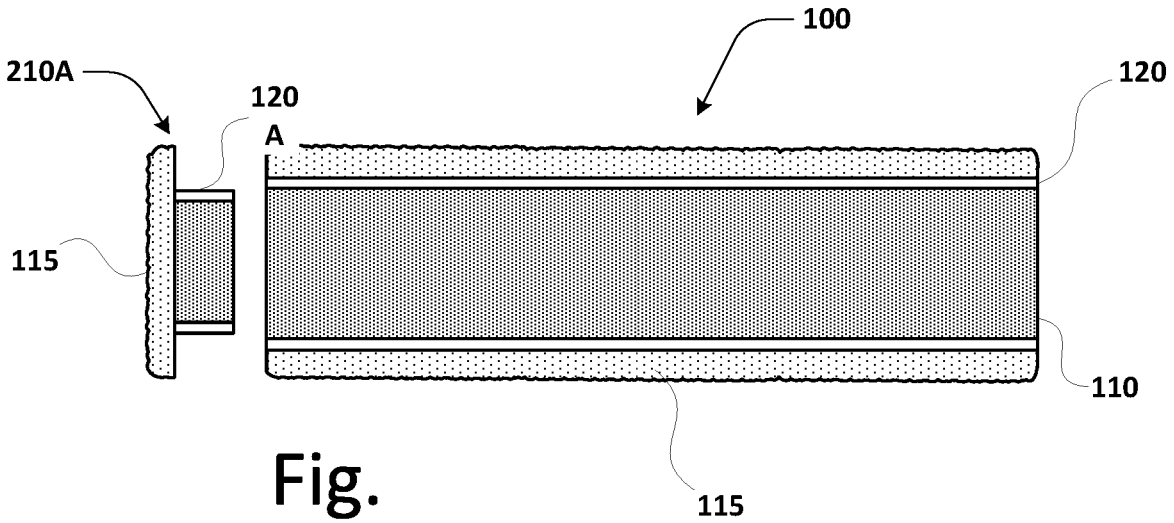
FIG. 6A is an exploded, cross-sectional view illustrating an example corner paint roller cover, in accordance with an embodiment.
Figure 6B:
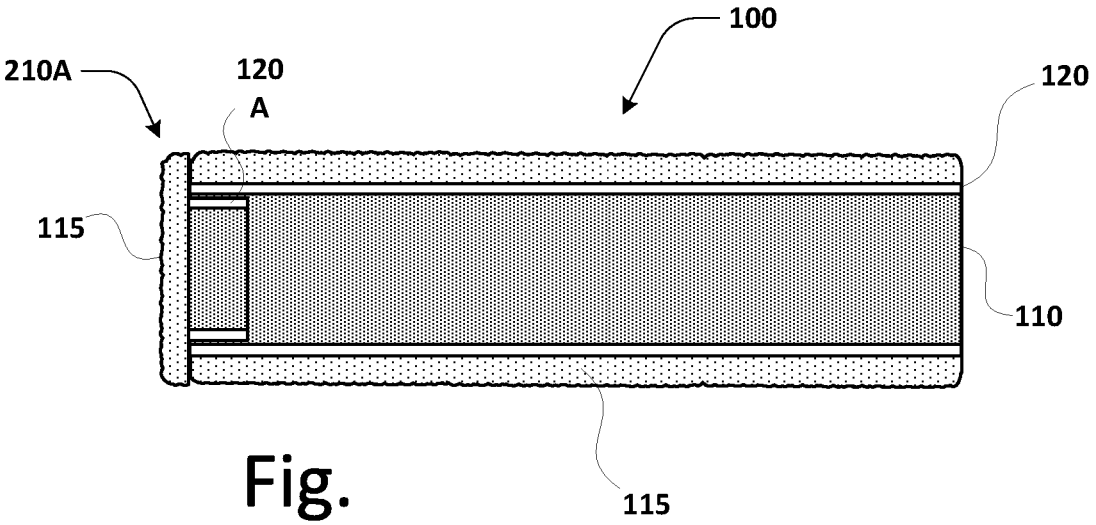
FIG. 6B is a cross-sectional view illustrating an example assembled corner paint roller cover, in accordance with an embodiment.

FIG. 6A is an exploded, cross-sectional view illustrating an alternate embodiment of a corner paint roller cover, in which the closed end of the paint roller cover is achieved using a separate component. FIG. 6B is a cross-sectional view showing an assembled alternate embodiment of the same embodiment. In this embodiment, a closed end can be added to a prior art paint roller cover 100 as a separate end cover 210A. The end cover 210A can include paint-absorbing material 115 attached to an attachment piece 120A. In the example embodiment shown in FIGS. 6A and 6B, the attachment piece 120A is designed as a short section of a hollow cylinder with an outer diameter designed to fit into inner core 120 of the paint roller cover 100. However, this embodiment is used as an example only, and there are various ways of attaching end cover 210A to paint roller cover 100 without deviating from the intent of the concepts presented herein. For example, end cover 210A may be attached to paint roller cover 100 or to the end piece (150, FIG. 1C) of a spring cage of a paint roller frame using spring clips, adhesives, double-sided tape, or any other appropriate attachment method.

Paint roller frames and paint roller covers come in various sizes, depending on the planned use. Typical paint roller cover sizes for home use include, but are not limited to, 4 inches, 7 inches, 9 inches, and 12 inches. Longer lengths are available, typically for use in commercial painting applications. The most common length of roller cover used in commercial painting applications is 18 inches. As the length of the paint roller cover increases, the standard single-roller frame (such as that illustrated in FIG. 1C) is inadequate, since the point of attachment of the frame to the spring cage is on one side of the roller, and it becomes difficult to maintain an even pressure across a longer paint roller, such as an 18-inch roller. In these cases, it can be advantageous to use an alternate frame which has been designed to hold an 18-inch or longer roller cover by both ends.

Figure 7:
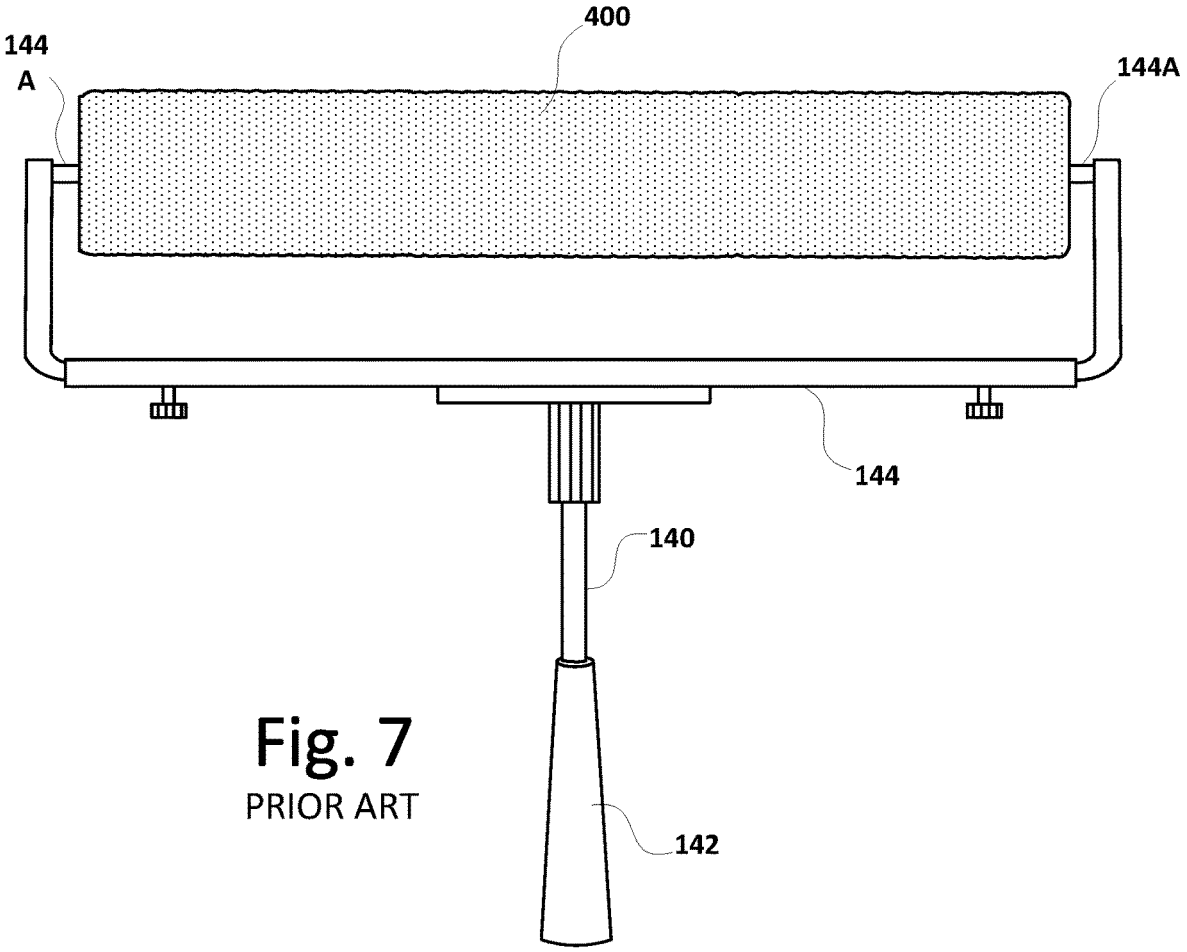
Fig. 7 PRIOR ART
FIG. 7 is a front view of a prior art double-length paint roller frame.

FIG. 7 provides a front view of one such double-length paint roller frame of the prior art. In this prior art example, a special, adjustable frame carriage 144 is attached to frame 140. The width of frame carriage 144 is adjustable, allowing a longer paint roller cover 400 to be mounted in between two roller spindles 144A. By supporting longer paint roller cover 400 at both ends on the roller spindles 144A, pressure applied by a painter gripping handle 142 is applied more evenly to the length of longer roller cover 400. While this is an improvement over standard prior art paint roller frames when used with longer paint roller covers, the design of frame carriage 144 eliminates the possibility of using a paint roller cover with a closed end, such as paint roller cover 200 from FIG. 2A.

Figure 8A:
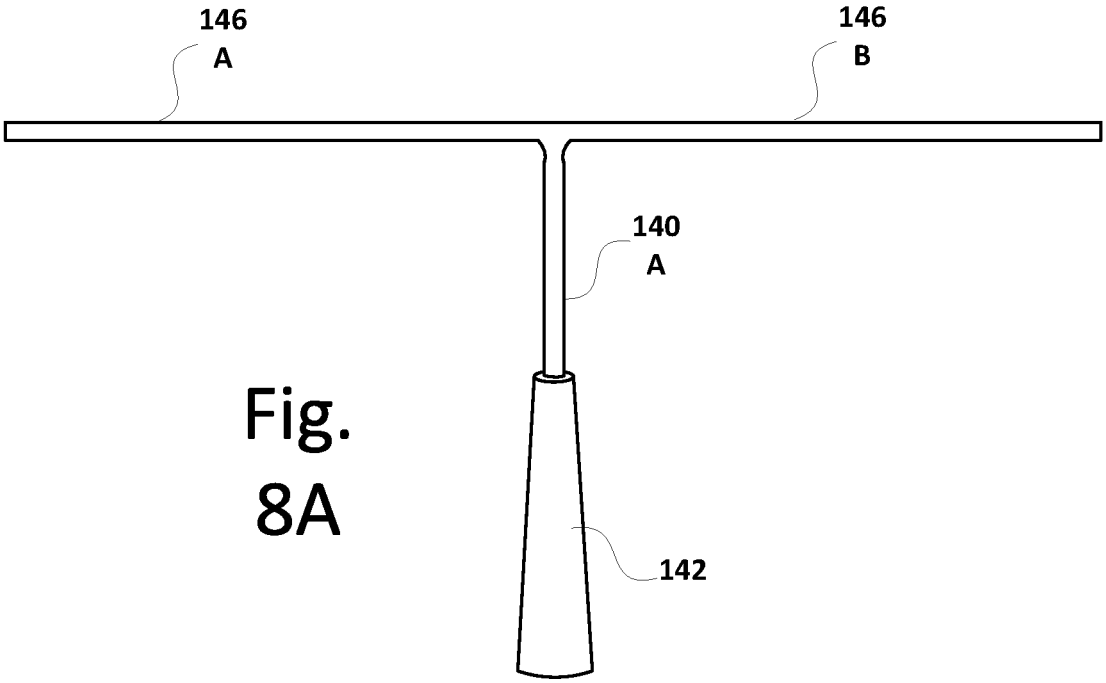
FIG. 8A is a front view of an example double-sided corner paint roller frame, in accordance with an embodiment.
Figure 8B:
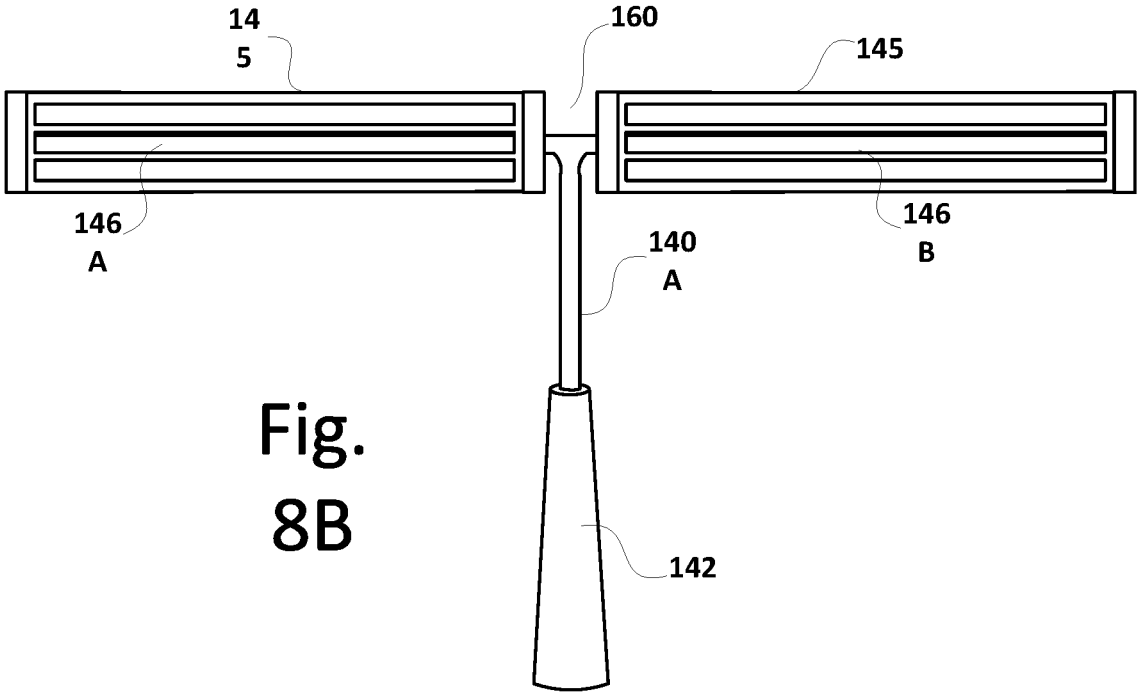
FIG. 8B is a front view of an example double-sided corner paint roller frame featuring roller cages, in accordance with an embodiment.
Figure 9:
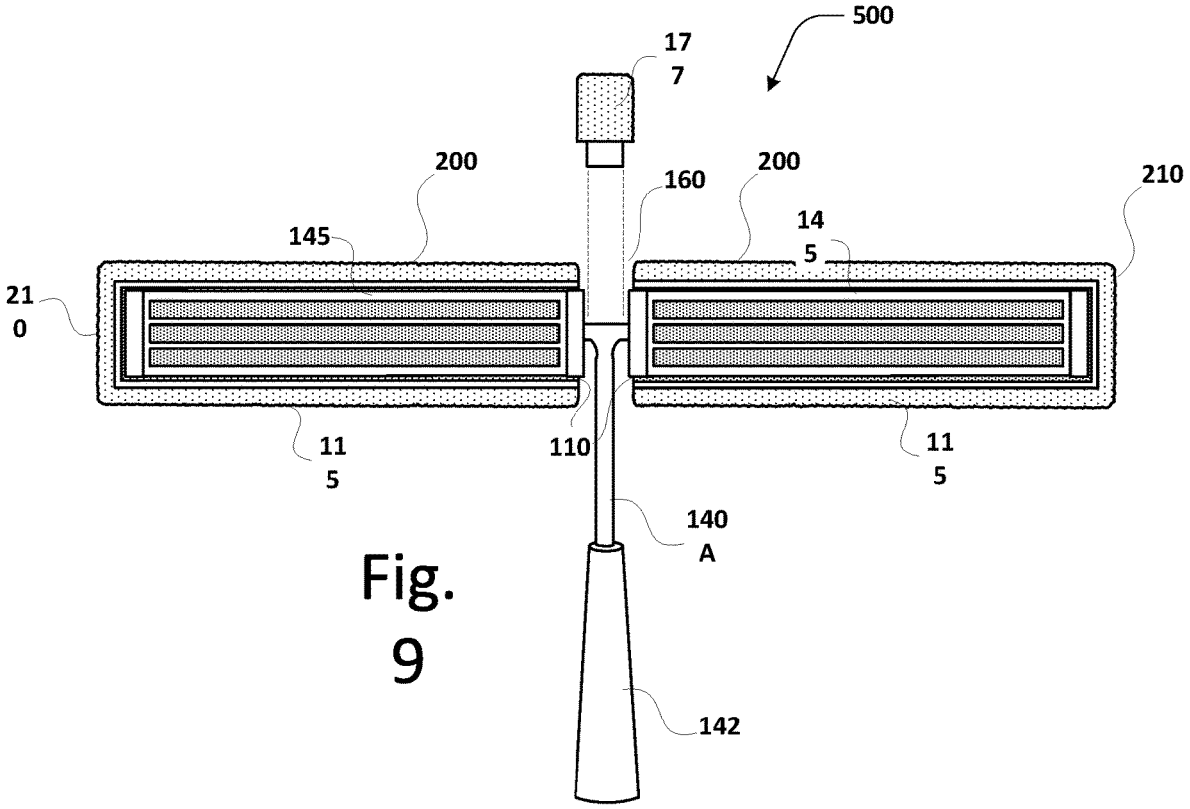
FIG. 9 is a front, cross-sectional view of an example double-sided corner paint roller assembly, in accordance with an embodiment.

FIGS. 8A, 8B, and 9 illustrate a new double-sided paint roller frame which allows the use of a closed-end paint roller cover (200, FIG. 2A) while still providing a wider paint surface. FIG. 8A is a front view of an embodiment of a double-sided corner paint roller frame. Frame 140A is a T-shaped piece with a stem attached to handle 142, and a cross-member structure splitting into a first branch 146A and a second branch 146B.

FIG. 8B illustrates the an embodiment of a double-sided corner paint roller frame featuring roller cages 145 in place, one attached to branch 146A and another attached to branch 146B. Because the stem of frame 140A necessarily attaches in the middle, between roller cages 145, a small gap 160 may exist between the roller cages 145. The width of this gap 160 can be minimized based on the design of frame 140A, and the width shown for gap 160 is for illustration purposes only and not intended to be limiting.

FIG. 9 is a front, cross-sectional view of a double-sided corner paint roller assembly 500 showing closed-end paint roller covers 200 in place. In the embodiment shown, a closed-end paint roller cover 200 is placed over each spring cage 145 and oriented such that the closed end 210 of each paint roller cover 200 faces out, and the open end 110 of each paint roller cover 200 faces in toward the center stem of frame 140A. This embodiment allows for corner painting using both sides of corner paint roller assembly 500. However, it is important to note that a standard, open-end paint roller cover (100, FIG. 1A) can be used in place of either or both of the closed-end paint roller covers 200.

Paint roller covers 200 can be designed to fit over spring cages 145 such that the gap 160 between paint roller covers 200 is substantially eliminated. In an alternate embodiment, a small gap closing attachment 177 covered in paint absorbing material 115 can be attached to the center point of the cross-member structure between first branch 146A and second branch 146B. However, any portion of a surface left uncovered by paint by a first, single pass of the corner paint roller assembly 500 will be mitigated by the typical W-shaped pattern in which a professional painter moves a paint roller when covering a surface.

Figure 10:
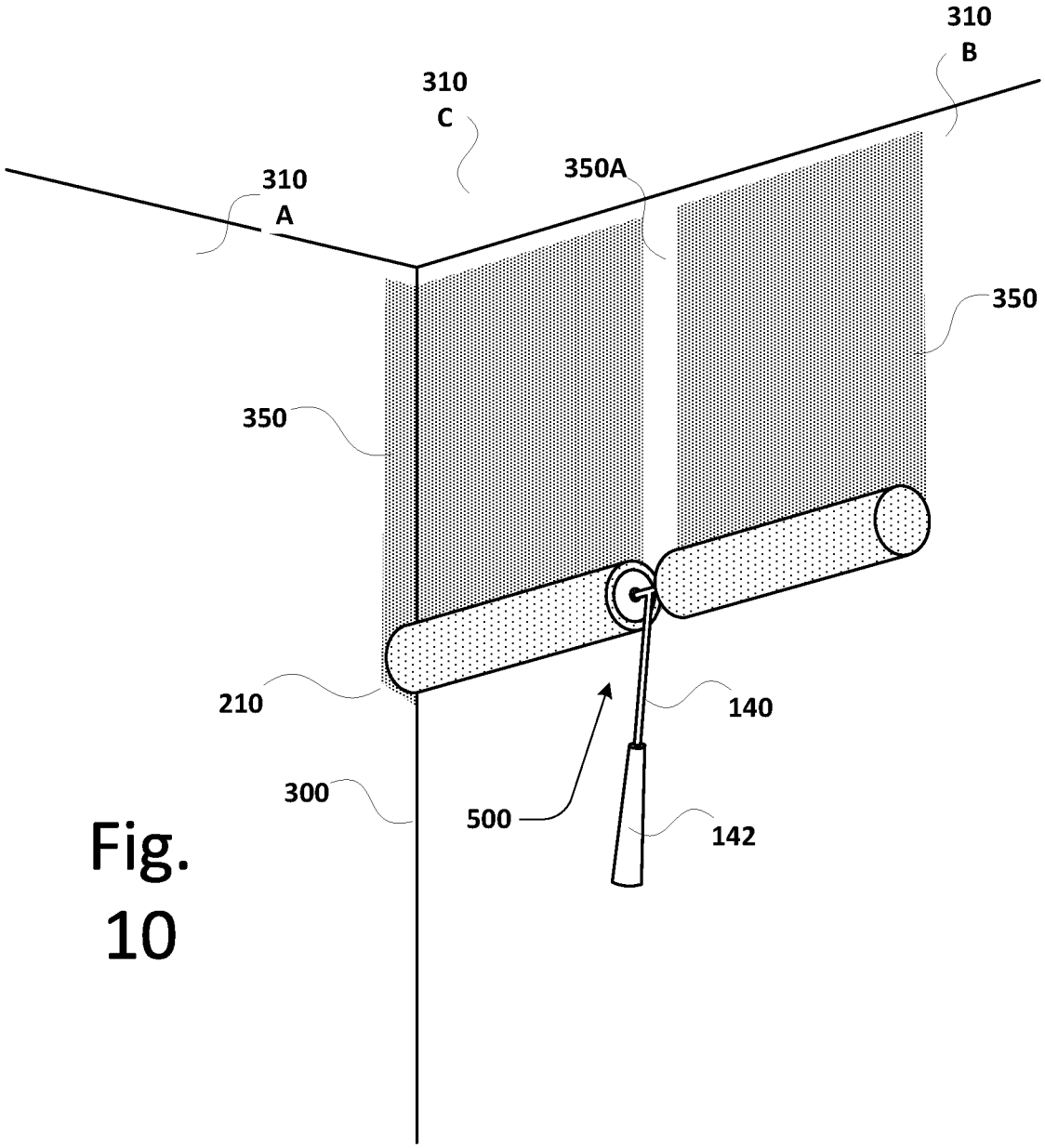
FIG. 10 is a perspective view of an example double-sided corner paint roller assembly applying paint to an inner corner of a room, in accordance with an embodiment.

Finally, FIG. 10 is a perspective view of a double-sided corner paint roller assembly 500 applying paint to an inner corner of a room. A corner 300 is shown formed by three adjacent surfaces, a first wall 310A, a second wall 310B, and a ceiling 310C. A user of the paint roller (not shown) holding the paint roller by handle 142 would move the paint roller over the surface of the wall 310B (for example), allowing paint 350 to be transferred from the double roller covers 200 onto the wall 310B. The closed end 210 of one of the roller covers 200 is in contact with wall 310A, and paint is being applied in corner 300 and onto wall 310A. Depending on the size of the gap (160, FIG. 9) between roller covers 200, a small strip of the wall being painted 350A may be left unpainted until the painter can move the double-sided corner paint roller assembly 500 on a subsequent pass to cover the strip 350A. It is important to note that, depending on the design of frame 140A and the depth of the pile used on roller covers 200, it may be possible to minimize or eliminate unpainted strip 350A, even on a first pass over the wall.

The described embodiments are susceptible to various modifications and alternative forms, and specific examples thereof have been shown by way of example in the drawings and are herein described in detail. It should be understood, however, that the described embodiments are not to be limited to the particular forms or methods disclosed, but to the contrary, the present disclosure is to cover all modifications, equivalents, and alternatives.

What is claimed is:

1. A paint roller assembly, comprising:

a T-shaped frame assembly comprising a handle and a frame, the frame comprising a first end engaged with the handle and a cross-member structure attached to the frame opposite and substantially orthogonal to the first end, the cross-member structure comprising a first branch and a second branch;

a first paint roller cage rotatably mounted on the first branch of the T-shaped frame assembly and further comprises two flat end caps mounted to each end of the first paint roller cage, wherein the first paint roller cage defines a hollow cylindrical structure constantly between the two flat end caps;

a first paint roller cover placed over the first paint roller cage comprising the two flat end caps and further comprising an inner core surrounded by a cylindrical structure of paint absorbing material, the first paint roller cover comprising a first end and a second end, wherein the first end of the first paint roller cover is a flat closed end integral with the cylindrical structure of paint absorbing material and abuts one of the two flat end caps of the first paint roller cage and wherein the second end of the first paint roller cover is an open end;

a second paint roller cage rotatably mounted on the second branch of the T-shaped frame assembly and further comprises two flat end caps mounted to each end of the second paint roller cage, wherein the second paint roller cage defines a hollow cylindrical structure constantly between the two flat end caps; and a second paint roller cover placed over the second paint roller cage comprising the two flat end caps and further comprising an inner core surrounded by a cylindrical structure of paint absorbing material, the second paint roller cover comprising a first end and a second end, wherein the first end of the second paint roller cover is a flat closed end integral with the cylindrical structure of paint absorbing material and abuts one of the two flat end caps of the second paint roller cage and wherein the second end of the second paint roller cover is an open end.

2. The paint roller assembly of claim 1, further comprising a member attached at a point between the first branch and the second branch of the cross-member structure, wherein the member is a paint roller cover that is located between the first paint roller cover and the second paint roller cover.

3. The paint roller assembly of claim 2, wherein the first paint roller cover and the second paint roller cover individually comprise:

an inner core defining a hollow cylinder, the inner core having a first end and a second end;

an end cap of the paint roller cover, the end cap of the paint roller cover mounted to the first end of the inner core, substantially covering the first end; and an outer cover comprising paint-absorbing material, the paint-absorbing material covering an outer surface of the inner core and at least a portion of an outer surface of the end cap.

4. The paint roller assembly of claim 3, wherein the end cap of the paint roller cover defines at least one hole, wherein the at least one hole allows air to pass through the end cap of the paint roller cover, aiding in a removal of the paint roller cover from a paint roller cage.

* * * * *